US006076763A

United States Patent [19]

Spatafora

[11] Patent Number: 6,076,763

[45] Date of Patent: Jun. 20, 2000

[54] REEL FEEDING METHOD AND DEVICE

[75] Inventor: Mario Spatafora, Bologna, Italy

[73] Assignee: GD. Societa' Per Azioni, Bologna, Italy

[21] Appl. No.: 09/247,166

[22] Filed: Feb. 9, 1999

[30] Foreign Application Priority Data

Feb. 17, 1998 [IT] Italy ..... BO98A0086

[51] Int. Cl.[7] ..... B65H 19/00

[52] U.S. Cl. ..... 242/559.1; 242/559.2; 414/911; 198/409

[58] Field of Search ..... 242/559.1, 559.2; 414/911, 908; 198/403, 409

[56] References Cited

U.S. PATENT DOCUMENTS

| | | | |
|---|---|---|---|
| 3,486,292 | 12/1969 | Ninneman | 198/403 X |
| 4,441,662 | 4/1984 | Seragnoli . | |
| 4,744,711 | 5/1988 | Heitmann et al. . | |
| 4,896,842 | 1/1990 | Heinz et al. | 242/559.1 |
| 5,031,381 | 7/1991 | Focke | 242/559.2 X |
| 5,135,103 | 8/1992 | Focke et al. | 242/559.1 X |
| 5,219,127 | 6/1993 | Boldrini et al. . | |
| 5,249,757 | 10/1993 | Draghetti et al. | 242/559.1 |
| 5,487,638 | 1/1996 | Salsburg et al. | 414/908 X |

FOREIGN PATENT DOCUMENTS

| | | | |
|---|---|---|---|
| 0521538 | 1/1993 | European Pat. Off. . | |
| 0618161 | 10/1994 | European Pat. Off. . | |
| 0820944 | 1/1998 | European Pat. Off. . | |
| 953231 | 3/1964 | United Kingdom | 198/403 |

*Primary Examiner*—Donald P. Walsh
*Assistant Examiner*—Minh-Chau Pham
*Attorney, Agent, or Firm*—Ladas & Parry

[57] ABSTRACT

A method and device for feeding reels from a store, in which the reels are aligned along a first axis coaxial with the reels, to an unwinding unit having a platform rotatable about a second axis, and at least one unwinding pin movable with the platform between a work position and an unwinding position; the unwinding pin is movable, with respect to the platform, between the work position and a loading position in which the unwinding pin is aligned with the first axis; and each reel is fed onto the unwinding pin in the loading position by moving the reel along the first axis.

15 Claims, 2 Drawing Sheets

REEL FEEDING METHOD AND DEVICE

FIELD OF THE INVENTION

The present invention relates to a reel feeding method.

More specifically, the present invention relates to a method of feeding reels of packing material from a store to an unwinding unit of a user machine.

The device according to the present invention may be used to advantage on automatic packing or manufacturing machines, to which the following description refers purely by way of example.

BACKGROUND OF THE INVENTION

Packing machines are known to feature reel feeding devices for successively transferring reels from a store to an unwinding unit by means of a transfer device having an arm fitted with gripping members for picking up and retaining a reel. To transfer the reels, the arm is moved cyclically from a pickup station at the store to a supply station at the unwinding unit.

In particular, U.S. Pat. No. 4,441,662 describes a device for feeding reels from a store, along which the reels are fed parallel to their respective axes and in a supply direction to an unwinding unit. The device features a guide extending in a conveying direction crosswise to the supply direction of the store, and which supports a slide traveling along the guide in the conveying direction. The slide supports an arm, which rotates with respect to the slide about an axis of rotation parallel to the conveying direction, and is fitted with gripping members for gripping a reel.

The cyclic movement, between the pickup and supply stations, of the arm fitted with the gripping members comprises longitudinal movements in the conveying direction, and transverse movements in a direction crosswise to the conveying direction. The transverse movements are performed by rotating the arm as described, while the longitudinal movements are performed by the slide moving as described along the guide.

The feeding device described in the above patent is mechanically complex, by a moving part—the slide—supporting a further part—the arm—in turn movable with respect to the slide, as well as the respective actuating means. And the situation is further complicated by the arm also supporting moving parts—the gripping members—and the respective actuating means.

SUMMARY OF THE INVENTION

It is an object of the present invention to provide a reel feeding method involving none of the aforementioned drawbacks and which, in particular, is straightforward and cheap to implement.

According to the present invention, there is provided a method of feeding reels from a store, in which said reels are aligned with one another along a first axis coaxial with the reels, to an unwinding unit comprising a support facing an output end of said store, and at least one unwinding pin fitted to said support; the method comprising a loading step for loading a reel onto said unwinding pin, and being characterized by said loading step comprising the steps of moving the unwinding pin with respect to the support to move the unwinding pin from a work position to a loading position in which the unwinding pin is aligned with said first axis and facing said store; feeding a said reel along the first axis to load the reel onto the unwinding pin in the loading position; and moving the unwinding pin with respect to the support to restore the unwinding pin to said work position.

The present invention also relates to a reel feeding device.

According to the present invention, there is provided a reel feeding device comprising a store for supporting a number of reels aligned with one another along a first axis coaxial with the reels; first actuating means for moving said reels along the first axis; and an unwinding unit comprising a support facing an output end of said store, and at least one unwinding pin; characterized in that said unwinding unit comprises second actuating means for moving the unwinding pin, with respect to the support, between a work position and a loading position in which the unwinding pin is aligned with said first axis and faces said store.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
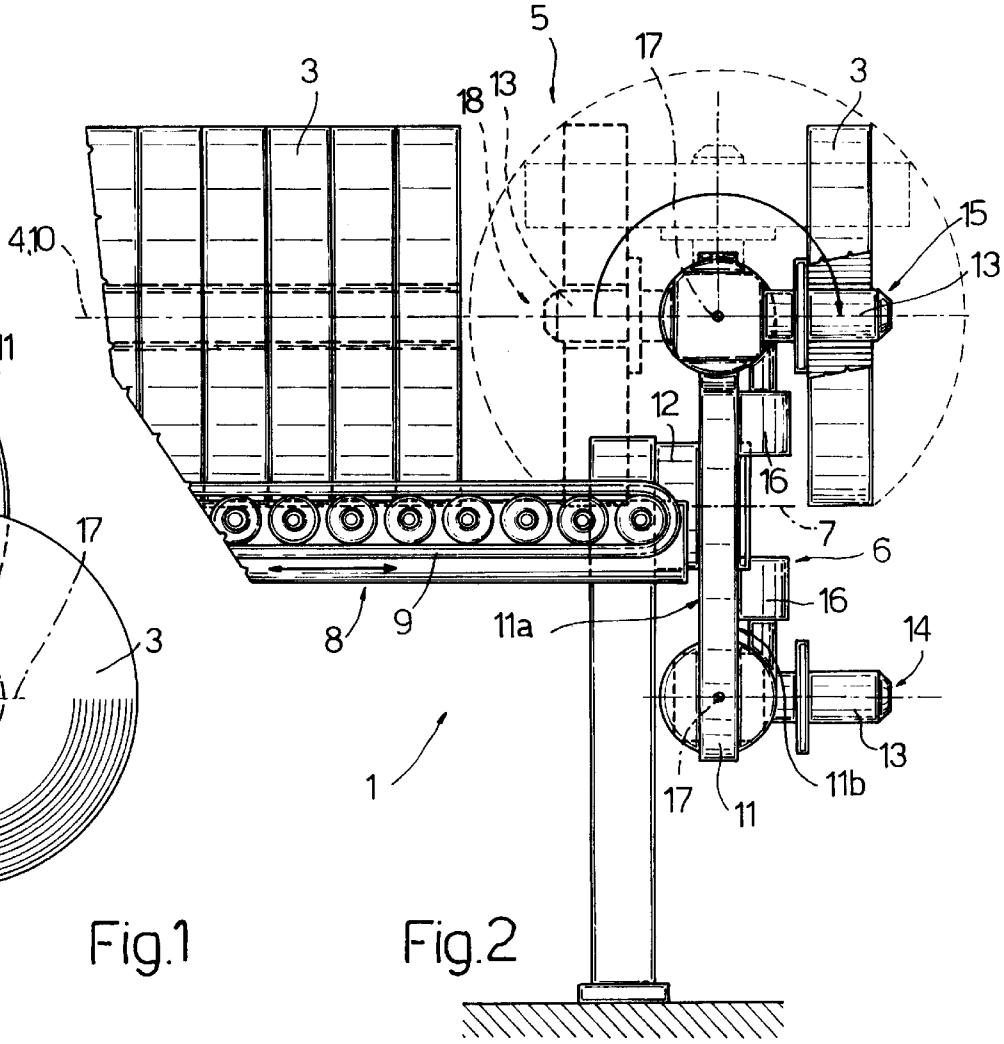
FIG. 2 shows a side view of the FIG. 1 device.
Figure 1:
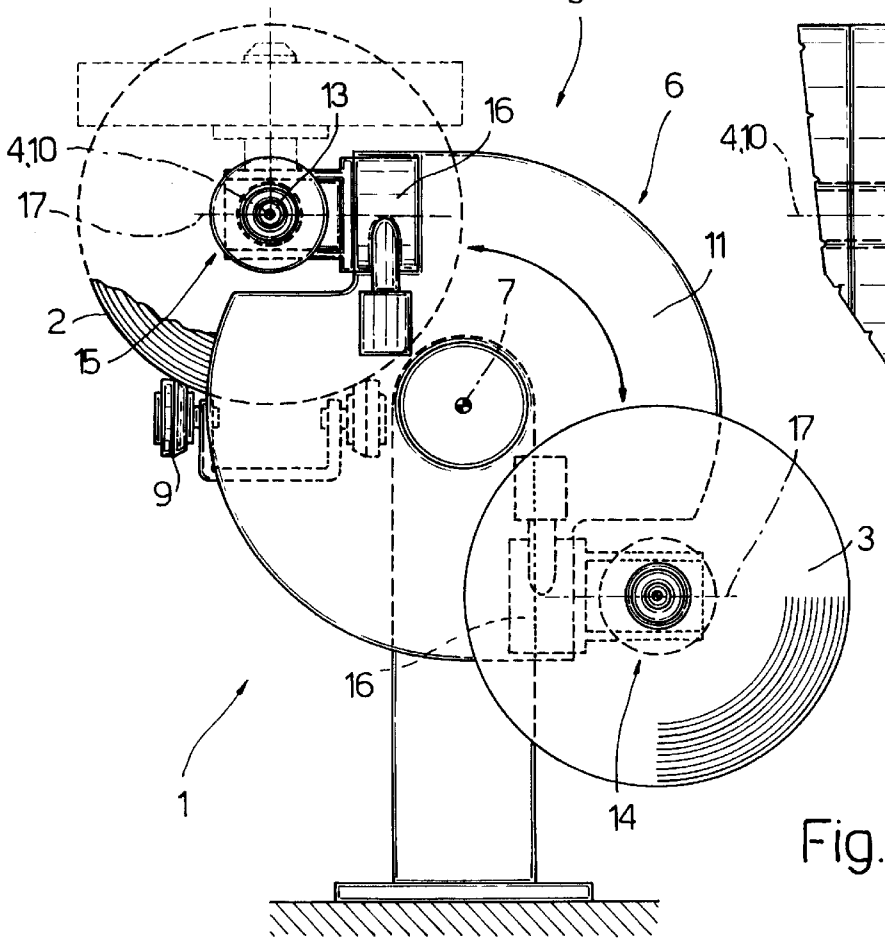
FIG. 1 shows a schematic front view of a preferred embodiment of the device according to the present invention.

Numeral 1 in FIGS. 1 and 2 indicates as a whole an automatic packing machine employing strip packing material 2, typically paper or similar, unwound off reels 3, each having a longitudinal axis 4.

Machine 1 comprises a device 5 for feeding reels 3, and in turn comprising an unwinding unit 6 having a substantially horizontal central axis 7 perpendicular to the FIG. 1 plane, and a known store 8 supporting a number of reels 3, which are transferred successively to unwinding unit 6.

In store 8, reels 3 are aligned, with respective axes 4 coaxial with one another; and store 8 comprises an actuating device 9 for moving reels 3 along store 8 in a supply direction 10 parallel to axis 7 and to axes 4.

Unwinding unit 6 comprises a known circular platform 11 connected to a drive unit 12 to rotate in steps, with respect to drive unit 12, about axis 7, and having a surface 11*a* facing the output end of store 8, and a surface lib on the opposite side of surface 11*a*. Platform 11 comprises two unwinding pins 13, each of which is normally parallel to axis 7, projects outwards of surface 11*b* of platform 11, and has known lock members (not shown) for retaining a respective reel 3.

Unwinding pins 13 are movable, together with platform 11, between an unwinding position 14 and a work position 15 in which one unwinding pin 13 projects from surface 11*b* and is coaxial with longitudinal axes 4 of reels 3 in store 8. To move from unwinding position 14 to work position 15 and vice versa, each unwinding pin 13 is rotated, together with platform 11, through 180° about axis 7 by drive unit 12.

Each unwinding pin 13 is fitted to platform 11 by means of a respective known actuating device 16 enabling unwinding pin 13 to rotate, with respect to platform 11, about an axis 17 crosswise to axis 7. When an unwinding pin 13 is in work position 15, axis 17 is horizontal and perpendicular to longitudinal axes 4 of reels 3 in store 8.

Each unwinding pin 13 is movable, with respect to platform 11, between work position 15 and a loading position 18 (shown by the dash line in FIG. 2) in which unwinding pin 13 is coaxial with axes 4 and projects outwards from surface 11*a* to face reels 3 in store 8. To move from work position 15 to loading position 18 and vice versa, each unwinding pin 13 is rotated, with respect to platform 11, through 180° about axis 17.

Operation of feeding device 5 will now be described as of the instant in which one free unwinding pin 13 is set to work position 15, while the other unwinding pin 13 is set to unwinding position 14 and supports a running-off reel 3.

The respective actuating device 16 is operated to move the free unwinding pin 13 from work position 15 to loading position 18 by rotating the pin through 180° about axis 17.

At this point, as stated, the free unwinding pin 13 is coaxial with and facing reels 3 in store 8; and actuating device 9 is operated to feed the first reel 3 in supply direction 10 and onto the free unwinding pin 13.

The known lock members (not shown) of unwinding pin 13 are then operated to retain the first reel 3, and actuating device 9 is operated to back up the other reels 3 in store 8 in supply direction 10, so that the first reel 3 loaded onto unwinding pin 13 is detached from the other reels 3 in store 8, and may be rotated about axis 17, together with respective unwinding pin 13, without interfering with the other reels 3 in store 8.

Actuating device 16 is then operated to move unwinding pin 13 and first reel 3 from loading position 18 to work position 15 by rotating the pin through 180° about axis 17.

Finally, as the reel 3 in unwinding position 14 on platform 11 runs out, drive unit 12 is operated to move the unwinding pin 13 with the new first reel 3 from work position 15 to unwinding position 14, and simultaneously move the other, by now empty, unwinding pin 13 from unwinding position 14 to work position 15.

The above operations are repeated cyclically.

Figure 4:
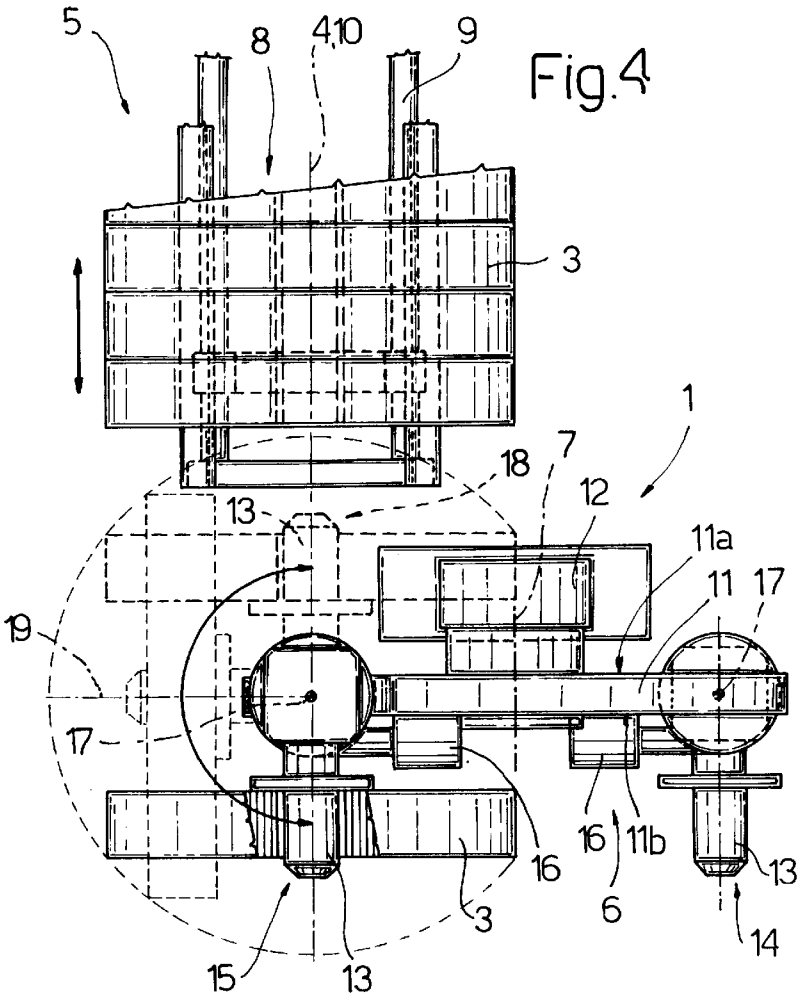
FIG. 4 shows a side view of the FIG. 3 device.
Figure 3:
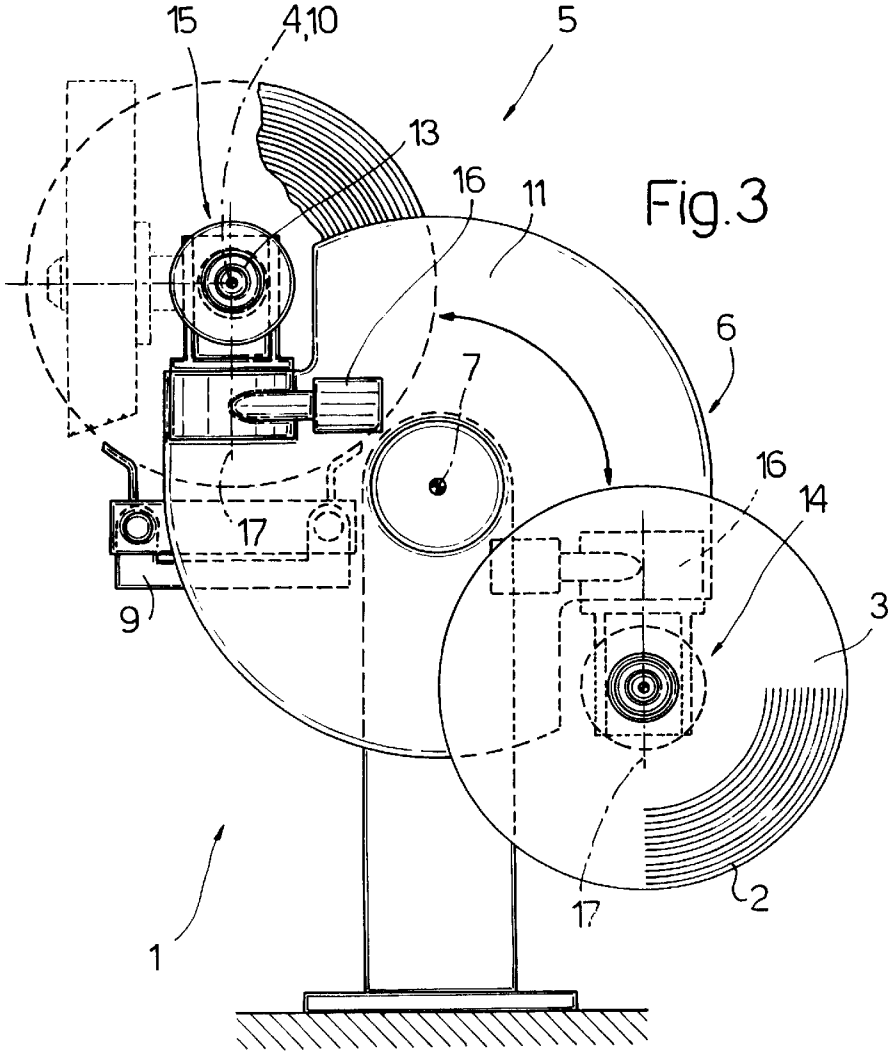
FIG. 3 shows a schematic front view of a further embodiment of the device according to the present invention.

In a different embodiment shown in FIGS. 3 and 4, the axis of rotation 17 of each unwinding pin 13 is vertical (as opposed to horizontal, as in FIGS. 1 and 2) when the unwinding pin 13 is in work position 15.

In yet a further embodiment (not shown) , store 8 comprises an actuating device capable of feeding one reel 3 at a time in supply direction 10 along the end portion of store 8 at unwinding unit 6, so that the first reel 3 is already detached from the other reels 3, which therefore need no longer be backed up once the first reel 3 is loaded onto the unwinding pin 13 in loading position 18.

In yet a further embodiment (not shown), supply direction 10 is not parallel to central axis 7. For example, supply direction 10 may be inclined with respect to the horizontal, in which case, axis of rotation 17 is not perpendicular to supply direction 10 when unwinding pin 13 is in work position 15. Alternatively, supply direction 10 may be parallel to the axis 19 shown in FIG. 4.

What is claimed is:

1. A method of feeding reels from a store (8), in which said reels (3) are aligned with one another along a first axis (4) coaxial with the reels (3), to an unwinding unit (6) comprising a support (11) facing an output end of said store (8), and at least one unwinding pin (13) fitted to said support (11); the method comprising a loading step for loading a reel (3) onto said unwinding pin (13), said loading step comprising the steps of moving the unwinding pin (13) with respect to the support (11) to move the unwinding pin (13) from a work position (15) to a loading position (18) in which the unwinding pin (13) is aligned with said first axis (4) and facing said store (8); feeding said reel (3) along the first axis (4) to load the reel (3) onto the unwinding pin (13) in the loading position (18); moving the unwinding pin (13) with respect to the support (11) to restore the unwinding pin (13) to said work position (15); and moving said support to move said unwinding pin with the reel loaded thereon from said work position to an unwinding position at which the reel can be unwound while on the unwinding pin.

2. A method as claimed in claim 1, wherein said support (11) is a rotary support rotatable about a second axis (7); the moving of the support to move the unwinding pin from the work position to the unwinding position comprising rotating said support about said second axis.

3. A method as claimed in claim 2, wherein said first axis (4) is parallel to said second axis (7).

4. A method as claimed in claim 1, wherein said unwinding pin (13) is rotated with respect to said support (11), between said work and loading positions (15, 18) about a third axis (17) perpendicular to said first axis (4).

5. A method as claimed in claim 4, wherein the unwinding pin (13) is rotated about said third axis (17) by a maximum of 180°.

6. A method as claimed in claim 4, wherein the unwinding pin (13) is rotated 180° about said third axis (17).

7. A reel feeding device comprising a store (8) for supporting a number of reels (3) aligned with one another along a first axis (4) coaxial with the reels (3), first actuating means (9) for moving said reels (3) along the first axis (4); and an unwinding unit (6) comprising a support (11) facing an output end of said store (8), and at least one unwinding pin (13) movably supported on said support; wherein said unwinding unit (6) comprises second actuating means (16) for moving the unwinding pin (13), with respect to the support (11), between a loading position (18) in which the unwinding pin (13) is aligned with said first axis (4) and faces said store (8) to receive a reel from said store and a work position, and a third actuation means for moving the support and the unwinding pin with the reel thereon from said work position to an unwinding position at which the reel can be unwound while on the unwinding pin.

8. A device as claimed in claim 7, wherein said support (11) is a rotary support rotatable about a second axis (7); said third actuating means (12) rotating the unwinding pin (13), together with the rotary support (11), between said work position (15) and said unwinding position (14).

9. A device as claimed in claim 8, wherein said first axis (4) is parallel to said second axis (7).

10. A device as claimed in claim 7, wherein said unwinding pin (13) is fitted to said support (11) so as to rotate with respect to said support about a third axis (17), which is perpendicular to said first axis (4) when said unwinding pin (13) is in said work position (15).

11. A device as claimed in claim 7, wherein said first actuating means (9) is reversible.

12. A method of feeding reels from a store (98), in which said reels (3) are aligned with one another along a first axis (4) coaxial with the reels (3), to an unwinding unit (6) comprising a support (11) facing an output end of said store (8), and at least one unwinding pin (13) fitted to said support (11); the method comprising a loading step for loading one said reel (3) onto said unwinding pin (13), said loading step comprising the steps of rotating the unwinding pin (13) with respect to the support (11) to rotate the unwinding pin (13) from a work position (15) to a loading position (18) in which the unwinding pin (13) is aligned with said first axis (4) and facing said store (8); feeding said one reel (3) along the first axis (4) to load the reel (3) onto the unwinding pin (13) in the loading position (18); rotating the unwinding pin (13) with respect to the support (11) to move the unwinding pin (13) to said work position (15) and moving said support (11) to move said unwinding pin (13) with said one reel loaded thereon between said work position (15) and an unwinding position (14) at which said one reel can be unwound while on said unwinding pin.

13. A method of feeding reels from a store (8), in which said reels (3) are aligned with one another along a first axis (4) coaxial with the reels (3), to an unwinding unit (6) comprising a support (11) facing an output end of said store (8), and at least one unwinding pin (13) fitted to said support (11); the method comprising a loading step for loading one said reel (3) onto said unwinding pin (13), said loading step comprising the steps of rotating the unwinding pin (13) with respect to the support (11) to move the unwinding pin (13) from a work position (15) to a loading position (18) in which the unwinding pin (13) is aligned with said first axis (4) and facing said store (8); feeding said one reel (3) along the first axis (4) to load the reel (3) onto the unwinding pin (13) in the loading position (18); rotating the unwinding pin (13) with respect to the support (11) to restore the unwinding pin (13) to said work position (15); and rotating said support (11) to move said unwinding pin (13) between said work position (15) and an unwinding position (14); said support (11) being rotated about a second axis (7); said unwinding pin (13) being rotated, with respect to said support (11), between said work and loading positions (15, 18) about a third axis (17) perpendicular to said first axis (4).

14. A reel feeding device comprising a store (8) for supporting a number of reels (3) aligned with one another along a first axis (4) coaxial with the reels (3); first actuating means (9) for moving said reels (3) along the first axis (4); and an unwinding unit (6) comprising a support (11) facing an output end of said store (8), and at least one unwinding pin (13) on said support; wherein said unwinding unit (6) comprises second actuating means (16) for rotating the unwinding pin (13), with respect to the support (11), about a second axis between a work position (15) and a loading position (18) in which the unwinding pin (13) is aligned with said first axis (4) and faces said store (8); and third actuating means for moving said support (11) around a third axis to move said unwinding pin (13) between said work position (15) and an unwinding position (14).

15. A reel feeding device comprising a store (8) for supporting a number of reels (3) aligned with one another along a first axis (4) coaxial with the reels (3); first actuating means (9) for moving said reels (3) along the first axis (4); and an unwinding unit (6) comprising a support (11) facing an output end of said store (8), and at least one unwinding pin (13) on said support; wherein said unwinding unit (6) comprises a second actuating means (16) for rotating the unwinding pin (13), with respect to the support (11), between a work position (15) and a loading position (18) in which the unwinding pin (13) is aligned with said first axis (4) and faces said store (8); said support (11) being rotatable about a second axis (7); and third actuating means (12) for rotating the rotatable support (11) and the unwinding pin therewith about a third axis (7), between said work position (15) and an unwinding position (14); said unwinding pin (13) being fitted to said support (11) so as to rotate about a third axis (17), which is perpendicular to said first axis (4).

* * * * *

UNITED STATES PATENT AND TRADEMARK OFFICE

CERTIFICATE OF CORRECTION

PATENT NO. : 6,076,763

DATED : June 20, 2000

INVENTOR(S) : Mario Spatafora

It is certified that error appears in the above-identified patent and that said Letters Patent are hereby corrected as shown below:

On title page, item 73, "GD." should read - - G. D - -.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*